US006309125B1

(12) United States Patent
Peters

(10) Patent No.: US 6,309,125 B1
(45) Date of Patent: Oct. 30, 2001

(54) MASCARA BRUSH APPLICATOR

(76) Inventor: Andrea Peters, 6600 Tawny Oak Dr., Plano, TX (US) 75024

( * ) Notice: Subject to any disclaimer, the term of this patent is extended or adjusted under 35 U.S.C. 154(b) by 0 days.

(21) Appl. No.: 09/580,962

(22) Filed: May 30, 2000

(51) Int. Cl.[7] ..... A46B 11/00
(52) U.S. Cl. ..... 401/127; 401/129; 401/126
(58) Field of Search ..... 401/124, 127, 401/128, 129, 130, 126; 132/762; 15/167.3, 167.1

(56) References Cited

U.S. PATENT DOCUMENTS 3,529,899 * 9/1970 Gruska ..... 401/127
4,498,490 * 2/1985 Seidler ..... 401/127
5,061,103 * 10/1991 Walsh-Smith ..... 401/127
5,328,282 * 7/1994 Charrier et al. ..... 401/127

FOREIGN PATENT DOCUMENTS

1459859 * 12/1976 (GB) ..... 401/126

* cited by examiner

*Primary Examiner*—David J. Walczak
(74) *Attorney, Agent, or Firm*—Dennis T. Griggs; Scott T. Griggs

(57) ABSTRACT

A mascara applicator includes a brush attached to a wand which is preformed with a predetermined bend angle which presents the brush in an offset orientation that makes it easier and more convenient to apply mascara to eyelashes. In a first embodiment, the wand is a narrow gauge wire or tube of a shape memory alloy which is characterized by pseudo-elasticity, and the wire or tube is deformed by a predetermined longitudinal bend angle in its relaxed memory recovery state. In an alternative embodiment, the wand includes link segments of a narrow gauge rod or tube of relatively stiff plastic material. At least two of the segments are joined together by a living hinge section which permits the wand to flex preferentially at the living hinge in response to a bending force. The living hinge is also characterized by flex memory recovery in which it automatically assumes a predetermined bend angle in the absence of a bending force.

13 Claims, 3 Drawing Sheets

MASCARA BRUSH APPLICATOR

BACKGROUND OF THE INVENTION

This invention relates to an adjustable cosmetic applicator for applying mascara to eyelashes.

In the art of facial make-up, mascara is used to darken and define eyelashes to accent the eyes. Typically, mascara is applied to the eyelashes after eyeshadow and eyeliner have been applied. Mascara is available in liquid form or in a light fluid paste preparation and is applied by a small brush that is attached to the end of a wand. The mascara is supplied from a tube-like dispenser container in which the wand and brush are inserted.

After mascara is loaded on the brush, a thin layer of mascara is applied to the upper eyelashes by moving the brush from the base to the tip of the eyelashes. The brush is then re-inserted into the dispenser until a desired amount of mascara has adhered to the brush. Additional coats of mascara can be applied to the upper eyelashes, if desired. The brush is then reloaded and mascara is applied to the lower lashes in the same manner. The ends of the eyelashes can also be coated with mascara by moving the brush horizontally across the tips. The brush is also used to separate the eyelashes and remove clumps.

A steady hand is required during the application of mascara so as not to smudge or smear previously applied foundation cosmetics. The person using the mascara brush must exert sufficient pressure to apply the mascara evenly to the lashes but not so much as to press the lashes against the skin where smudging will occur.

There may be some difficulty experienced when using a conventional wand applicator to apply mascara to either eye with one hand. The way mascara is usually applied is for the person to stand in front of a mirror, holding her head in an upward direction for applying mascara to the upper lashes and holding her head in a downward direction for applying mascara to the lower lashes. Occasionally, it is preferable to use only the tip of the applicator brush to apply additional mascara as close to the tips of the eyelashes as possible. This gives the illusion of a much longer eyelash. For a more pronounced look for evening wear, additional coats of mascara are applied from the base to the tip, and from top to bottom of the eyelashes.

Because of close proximity to the eye, the applicator must be handled carefully for accurate placement of the mascara to avoid eye contact and smudging.

Typically, the user of the applicator will hold the mascara container in her left hand, and hold the wand applicator in her right hand, while at the same time attempting to view the process in a make-up mirror. During the application when using the right hand to apply mascara to the left eyelashes, her hand must be bent or cocked in an unnatural or uncomfortable position. The procedure becomes more difficult when a normally right-handed person holds the wand applicator in her left hand or reverses the angle of the applicator brush when attempting to apply the mascara to eyelashes of the left eye.

There is a continuing interest in providing an improved mascara applicator in which the wand is adjustable from a conventional straight-line orientation to a predetermined bend angle which presents the brush in an angular offset orientation that makes it easier and more convenient to apply mascara to eyelashes.

BRIEF SUMMARY OF THE INVENTION

An adjustable mascara applicator includes a brush attached to a bendable wand which is characterized by recovery memory in which it automatically assumes a predetermined bend angle in the absence of bending force. In a first embodiment, the wand is an elongated wire or rod of a shape memory metal alloy which has pseudo-elasticity at room temperature, and is deformed by a predetermined longitudinal bend angle in its relaxed memory recovery state. In an alternative embodiment, the wand is formed by a plurality of link segments of a narrow gauge rod or tube of relatively stiff plastic material. At least two of the link segments are integrally formed with a living hinge section which is characterized by a resiliency which is greater than the resiliency of the link segments so that bending will occur preferentially at the living hinge section in response to a bending force applied to the wand. The living hinge has flex memory recovery which restores the hinge to a predetermined bend angle when the bending force is removed.

The wand is attached to a fixed guide rod and extends through a tubular support sleeve. The tubular support sleeve is slidably coupled in telescoping engagement with the guide rod for extension and retraction relative to the wand. When the support tube is fully extended, the flex memory effect is overcome by engagement of the bend angle segments against the internal sidewall of the support sleeve which maintains the wand and brush in a straight-line orientation. As the support sleeve is retracted along the guide rod, the wand is exposed, thus permitting the bend angle segments to flex and recover to a predetermined bend angle which presents the brush at an offset angle which makes it easier and more convenient to apply mascara to eyelashes.

BRIEF DESCRIPTION OF THE DRAWING

The accompanying drawing is incorporated into and forms a part of the specification to illustrate the preferred embodiments of the present invention. Various advantages and features of the invention will be understood from the following detailed description taken in connection with the appended claims and with reference to the attached drawing figures in which:

DETAILED DESCRIPTION OF THE INVENTION

Figure 1:
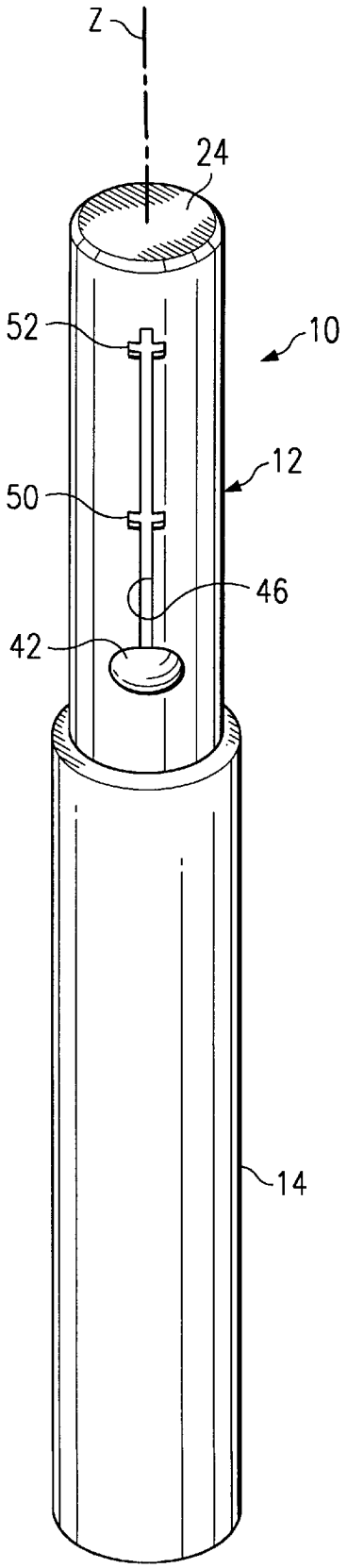
FIG. 1 is a perspective view of one embodiment of a mascara applicator constructed according to the present invention.

Preferred embodiments of the invention will now be described with reference to various examples of how the invention can best be made and used. Like reference numerals are used throughout the specification and several views of the drawing to indicate like or corresponding parts.

Figure 5:
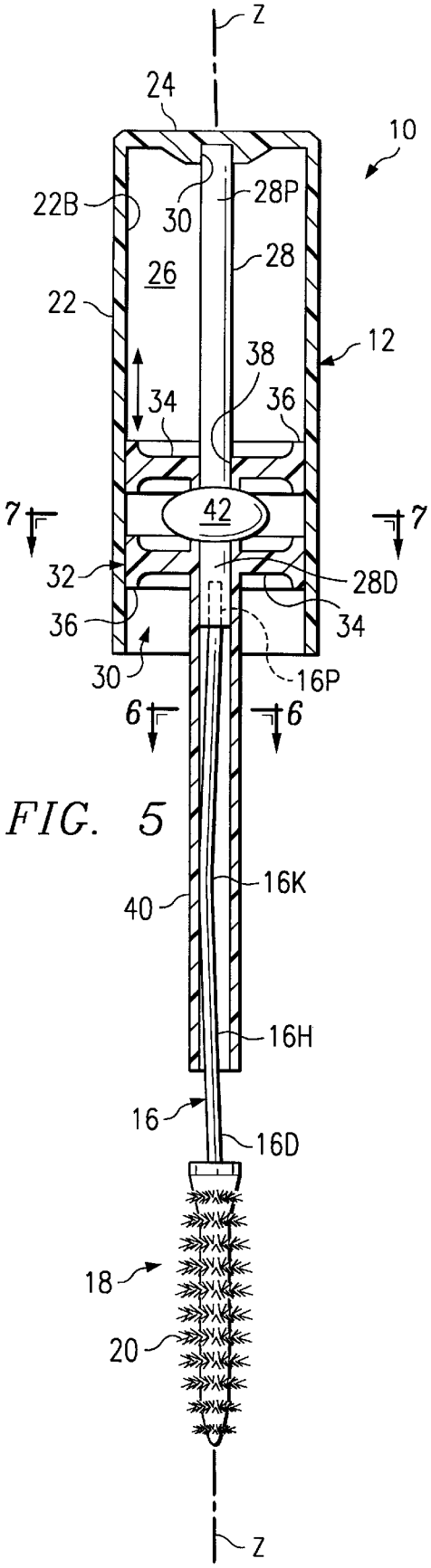
FIG. 5 is a longitudinal sectional view of the mascara applicator and handle assembly.

Referring now to FIG. 1 and FIG. 5, the mascara applicator 10 of the present invention includes a cylindrical handle 12 which also serves as a closure cap that is mateable with a mascara dispenser container 14. The mascara applicator 10 includes an elongated wand or shaft 16 which projects in coaxial alignment with the handle 12. A brush 18 formed by tufts or bristles 20 is attached to the distal end portion 16D and the proximal end portion 16P of the wand is attached to the handle. The container 14 holds a volume of liquid mascara. The brush 18 is inserted into the container 14 and the handle 12 serves as a closure cap for sealing the container when it is not being used.

Upon insertion, the brush 18 is submerged within the liquid mascara and absorbs a volume of the mascara on the bristles 20. Upon removal of the brush applicator from the container, excess mascara is removed by drawing the brush across an elastic wiper, thus leaving a metered or fixed amount of mascara on the bristles.

Preferably, the mascara is a fluid composition having a viscosity in the range between 1,500–25,000 poises at ambient temperature. The mascara brush 18 has about 600 strands of 0.004 nylon fiber twisted to a length of approximately ¾". The brush 18 is used to comb through the eyelashes, coat the eyelashes on all sides, remove excess mascara and separate the lashes. The brush separates and combs through the eyelashes as it simultaneously applies the mascara in an even and uniform manner.

Referring again to FIG. 5, the cylindrical handle 12 includes a tubular sidewall 22 and a cap 24 which partially enclose an interior space 26. A rigid guide rod 28 extends at least partially through the interior space in coaxial alignment with the cylindrical handle 12. The guide rod 28 is attached to the handle 12 and is held in coaxial alignment with the longitudinal axis Z of the handle 12 by adhesively bonding its proximal end portion 28P within an index bore 30 formed in the underside of the cap 24.

The brush 18 is attached to the distal end portion 16D of the wand 16, for example by crimping, adhesive bonding or by a thermal weld. The proximal end 16P of the wand 16 is attached to the distal end portion 28D of the guide rod 28. According to this arrangement, the wand 16 extends in coaxial alignment with the guide rod 28 and the cylindrical handle 12, and projects through the lower opening 30 of the hollow handle 12.

Figure 2:
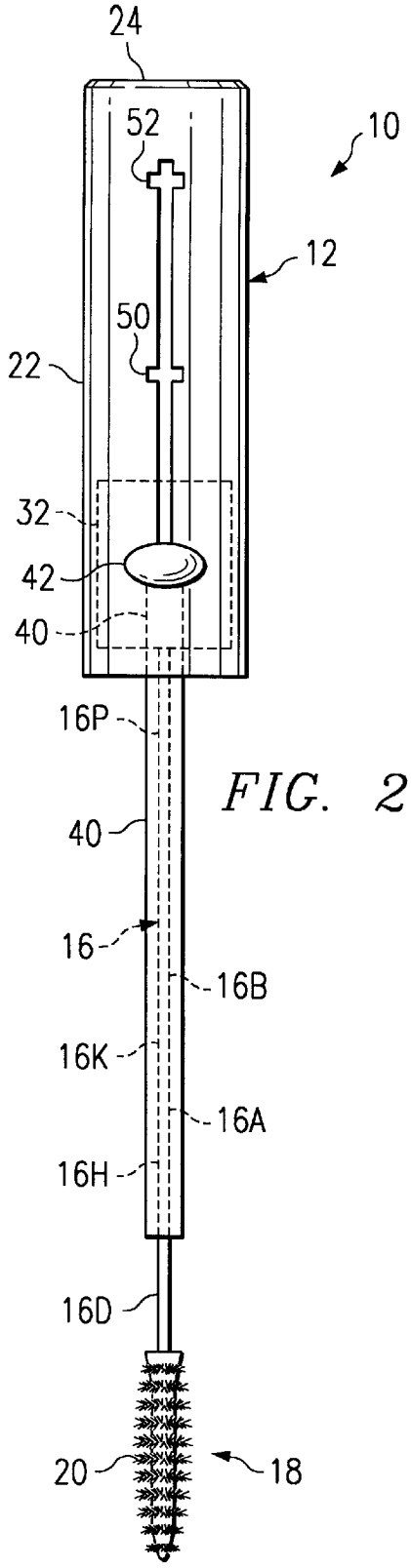
FIG. 2 is an elevational view of the applicator showing the wand in the straight configuration with the support sleeve in the fully extended position.
Figure 4:
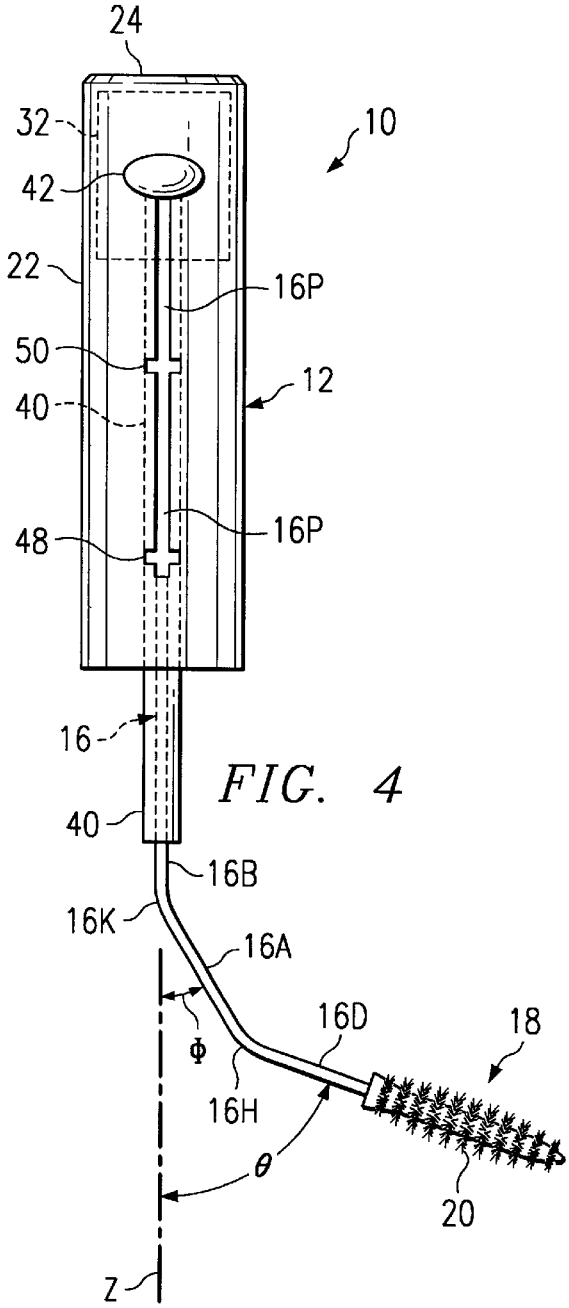
FIG. 4 is a view similar to FIG. 3, with the support sleeve fully retracted and the wand bent through an angle of about 75°.

The guide rod 28 is further stabilized and supported by an alignment collar 32 which is slidably mounted on the guide rod 28 for longitudinal extension and retraction movement through the interior handle space 26 from a fully extended position, as shown in FIG. 2, to a fully retracted position as shown in FIG. 4. The alignment collar 32 includes a circular spacer web 34 which is bounded radially by a cylindrical flange 36. The cylindrical flange is disposed in slidable engagement against the bore 22B of the handle sidewall 22. The spacer web 34 is intersected by an alignment bore 38 which is dimensioned for a smooth sliding fit around the guide rod 28.

In the preferred embodiment, the alignment collar 32 is slidably coupled in telescoping engagement with the guide rod 28 by a tubular support sleeve 40. Preferably, the tubular support sleeve 40 is integrally formed with the alignment collar 32, and is slidable along the guide rod 28 through the interior space 26 between the fully extended position (FIG. 2) and the fully retracted position (FIG. 4). The length of the tubular support sleeve 40 is slightly less than the length of the wand 16 so that only the short distal segment 16D of the wand is exposed when the support sleeve 40 is in the fully extended straight-line position as shown in FIG. 2 and in FIG. 5.

Figure 7:
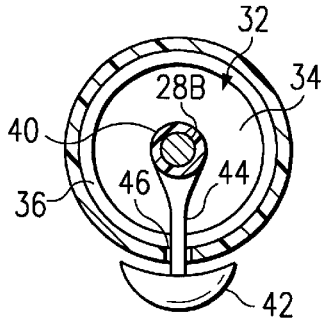

Referring now to FIG. 1, FIG. 5 and FIG. 7, the alignment collar 32 and the support sleeve 40 are manually extended and retracted by applying thumb pressure against an adjustment button 42. The adjustment button is rigidly attached to the alignment collar 32 and/or the support sleeve 40 by a connecting arm 44 which is preferably integrally formed with the support sleeve 40.

Referring now to FIG. 1, FIG. 2, FIG. 3 and FIG. 4, the support sleeve 40 is extended and retracted along the longitudinal axis Z by applying finger pressure against the adjustment button 42 which causes displacement of the alignment collar 32 along the guide rod 28 and through the handle space 26. The connecting arm 44 travels through a longitudinal slot 46 that is formed in the handle 12. Circumferential detent notches 48, 50 and 52 are also formed in the handle sidewall 22 for fixing the extended or retracted position of the support sleeve 40 at the fully extended, straight-line position shown in FIG. 2, the intermediate position shown in FIG. 3 (corresponding with bend angle ) and the fully retracted position shown in FIG. 4 (corresponding with bend angle $\phi$). The alignment collar 32, support sleeve 40 and connecting arm 44 are rotatable about the fixed guide rod 28 which permits the connecting arm 44 to move into detented engagement within each notch.

Figure 3:
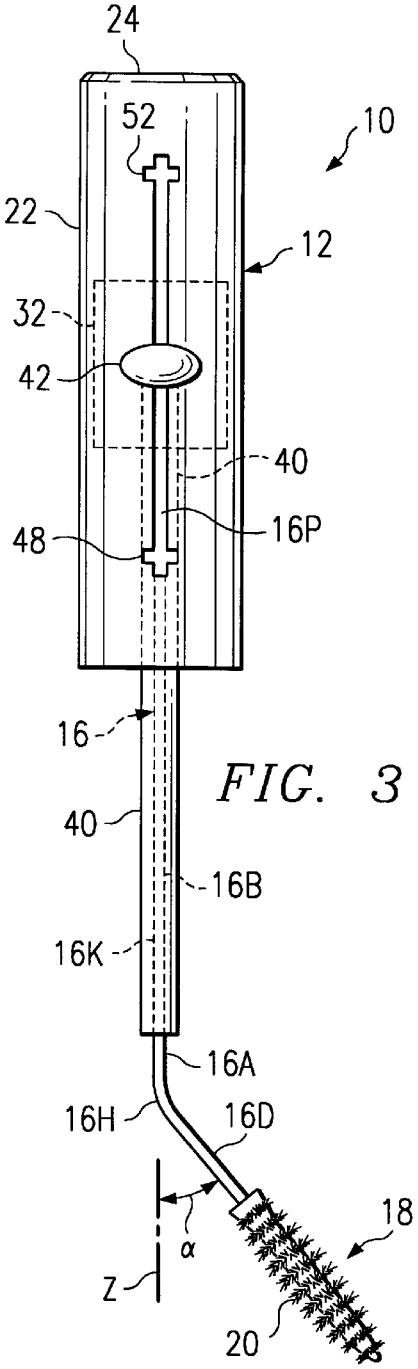
FIG. 3 is a view similar to FIG. 2, with the wand bent at a 45° angle and the support sleeve partially retracted to an intermediate position.

According to an important feature of the present invention, the wand 16 is constructed of a bendable material which is characterized by flex memory recovery, and the wand is permanently bent to a predetermined bend angle and automatically assumes or recovers to the predetermined bend angle in the absence of a bending force or upon removal of a bending force. According to a first embodiment of the invention, the wand 16 is an elongated wire or rod constructed of a shape memory metal alloy that has pseudo-elasticity at room temperature. Referring to FIG. 3 and FIG. 4, the wand 16 is deformed by a first predetermined bend angle alpha ( ) at a first bend location 16H which is spaced at about one-half inch from the brush 18. A second bend angle phi ($\phi$) is formed at a second bend location 16K which is spaced inwardly from the brush by about one inch. As shown in FIG. 3 and FIG. 4, the bend angles and $\phi$ are measured from the longitudinal axis Z of the handle 12 to the wand segments 16D, 16A, respectively. Preferably, the bend angle is approximately 45°, and the bend angle $\phi$ is approximately 30°, thus yielding a total bend angle theta ($\theta$) of about 75°. The wand segments 16D, 16A and 16B which form the longitudinal bend angles are coplanar.

In the preferred embodiment, the wire or rod which forms the wand 16 is constructed of a shape memory metal alloy that exhibits pseudo-elasticity at room temperature, for example an alloy of vanadium (V), titanium (Ti) and nickel (Ni) as disclosed in U.S. Pat. No. 4,894,100 entitled "Ti—Ni—V Shape Memory Alloy," which is incorporated herein by reference. The term "shape memory alloy" refers to a group of metallic materials that are highly elastic and have the ability to return to some previously defined shape or size after being stressed by a mechanical force, upon removal of the bending stress. That is, after the bending force or stress is removed, the shape memory alloy material will return to its original shape without any plastic deformation. The Ti—Ni—V shape memory alloy described in U.S. Pat. No. 4,894,100 has the ability to recover to its original shape at relatively low room temperatures.

Preferably, the shape memory alloy material is characterized by pushability, kink-resistance and torquability. "Pushability" refers to the ability to apply a force at the proximal end of an elongated strip of the shape memory alloy material, so that the force is transferred to the distal end of the material. Stiff wires provide good pushability (axial rigidity) but poor kink-resistance. Kink-resistance is measured by the ability of the wire to be forced into a relatively tight bend radius without permanently deforming the wire core. "Torquability" relates to how well a rotational force imparted to the proximal end of the shape memory alloy wand is translated to the distal end of the wand.

A suitable wand 16 made of Ti—Ni—V shape memory alloy material is preferably in the form of a continuous rod or wire having a circular cross-section and a diameter in the range of about 10 mils (about 30 gauge) to about 20 mils (about 24 gauge).

According to an alternative embodiment of the invention, the wand 16 consists of a narrow gauge rod or tube of relatively stiff plastic material, with the wand segments 16D, 16A and 16B being joined together by living hinge sections 16H, 16K. Each living hinge section 16H, 16K is characterized by a resiliency which is greater than the resiliency of each wand segment, so that bending will occur preferentially at the living hinge section in response to a bending force applied to the wand. Moreover, the relatively resilient material of each living hinge 16H, 16K is characterized by memory recovery such that after a bending force is removed, the hinge reverts back to the predetermined bend angle , ϕ, respectively.

Preferably, the wand 16 of the alternative embodiment is constructed of a narrow gauge rod or tube of polyester resin having a diameter in the range of about 20 mils (24 gauge) to about 33 mils (20 gauge). The resiliency of each hinge section 16H, 16K is increased relative to the resiliency of the wand segments, for example modification of the wand by optical treatment, chemical treatment and/or thermal treatment at selected locations. The wand segments and the living hinge sections are integrally formed together, and the living hinge sections are modified to have increased resiliency so that when mechanical stress is applied to the wand, bending occurs at the living hinge sections 16H, 16K, in preference to occurring in the wand segments 16D, 16A and 16B.

For purposes of understanding the present invention, the term "resiliency" is considered to be the opposite of "rigidity" and includes the property of flexibility inasmuch as the living hinge will not wear out, crack or separate in response to a predetermined number of bending flexes that are likely to be encountered during the useful life of the mascara applicator 10. Moreover, the wand segments 16D, 16A and 16B, and living hinge sections 16H, 16K are coplanar, and the bend angles , ϕ are preformed in the wand during manufacture.

After being treated or modified to enhance its resiliency, each living hinge also possesses flex memory recovery whereby after a flexing force has been applied and removed from the wand, the wand reverts back to its relaxed, pre-bent angular shape prior to the exertion of the flexing force, as shown in FIG. 3 and FIG. 4.

Figure 6:
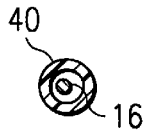
FIG. 6 is a sectional view thereof, taken along the line 6—6 of FIG. 5; and, FIG. 7 is a sectional view thereof, taken along the line 7—7 of FIG. 5.

Referring now to FIG. 6, the diameter of the support sleeve 40 is approximately three times the diameter of the wand 16. The support sleeve is made of a relatively rigid plastic or metal material which is strong enough to flatten or deflect the preformed bend angle segments upon extension of the support sleeve to the straight wand configuration as shown in FIG. 2 and FIG. 5.

Although the invention has been described with reference to certain exemplary arrangements, it is to be understood that the forms of the invention shown and described are to be treated as preferred embodiments. Various changes, substitutions and modifications can be realized without departing from the spirit and scope of the invention as defined by the appended claims.

What is claimed is:

1. An adjustable brush applicator comprising, in combination:

a hollow handle including a tubular sidewall at least partially enclosing an interior space;

a guide rod attached to the handle and extending at least partially through the interior space;

a tubular support sleeve having an elongated bore slidably coupled in telescoping engagement with the guide rod for reciprocal longitudinal movement through the interior space from a retracted position to an extended position;

an elongated wand extending through the support sleeve bore, the elongated wand including a proximal end portion attached to the guide rod and a distal end portion projecting out of the support sleeve;

a brush attached to the distal end portion of the wand; and wherein the wand comprises an elongated rod or tube of an elastic material that is characterized by shape memory recovery, the rod or tube being deformed by a predetermined bend angle in its relaxed memory recovery state.

2. An adjustable brush applicator as set forth in claim 1, wherein the elongated rod or tube is deformed by a first predetermined bend angle and by a second predetermined bend angle in its relaxed memory recovery state, the first bend angle deformation and the second bend angle deformation being longitudinally spaced along the length of the wand between the applicator brush and the guide rod.

3. An adjustable brush applicator as set forth in claim 1, wherein:

a manually operable slide button is coupled to the tubular support sleeve for manually moving the support sleeve from the retracted position to the extended position.

4. An adjustable brush applicator as set forth in claim 1, wherein:

an alignment collar is slidably mounted on the guide rod for reciprocal axial movement through the interior space from the retracted position to the extended position; and, the tubular support sleeve is attached to the alignment collar.

5. An adjustable brush applicator as set forth in claim 4, wherein:

the alignment collar includes a web spacer portion bounded radially by a peripheral flange which is disposed in slidable engagement against the tubular handle sidewall, and the web portion is intersected by an alignment bore; and, the guide rod projects through the alignment bore.

6. An adjustable brush applicator comprising, in combination:

a hollow handle including a tubular sidewall at least partially enclosing an interior space;

a guide rod attached to the handle and extending at least partially through the interior space;

a tubular support sleeve having an elongated bore slidably coupled in telescoping engagement with the guide rod for reciprocal longitudinal movement through the interior space from a retracted position to an extended position;

an elongated wand extending through the support sleeve bore, the elongated wand including a proximal end portion attached to the guide rod and a distal end portion projecting out of the support sleeve;

a brush attached to the distal end portion of the wand; and wherein the wand comprises an elongated wire or rod of a shape memory metal alloy which is characterized by shape memory recovery, and the wire or rod is deformed by a predetermined bend angle in its relaxed memory recovery state.

7. An adjustable brush applicator as set forth in claim 6, wherein the predetermined bend angle is approximately 45°.

8. An adjustable brush applicator as set forth in claim 6, wherein the wire or rod is deformed by a first predetermined bend angle and by a second predetermined bend angle in its relaxed memory recovery state, the first bend angle deformation and the second bend angle deformation being longitudinally spaced along the wand between the applicator brush and the guide rod.

9. An adjustable brush applicator as set forth in claim 8, wherein the first predetermined bend angle is approximately 45°, and the second predetermined bend angle is approximately 30°.

10. An improved brush applicator as set forth in claim 6, wherein the shape memory metal alloy comprises vanadium, titanium and nickel.

11. An adjustable brush applicator as set forth in claim 1, wherein the wand comprises a plurality of wand segments, each wand segment comprising a narrow gauge rod or tube of relatively stiff plastic material; and, at least two of the wand segments being joined together by a living hinge section which is characterized by a resiliency which is greater than the resiliency of the wand segments so that bending will occur preferentially at the living hinge section in response to a bending force applied to the wand.

12. An adjustable brush applicator as set forth in claim 1, wherein the wand comprises a plurality of wand segments, each wand segment comprising a narrow gauge rod or tube of relatively stiff plastic material;

at least two of the wand segments being joined together by a living hinge section, wherein the living hinge section is deformed by a predetermined bend angle and the relatively resilient material of the living hinge segment is characterized by flex memory recovery such that after a bending force is removed, the hinge recovers to the predetermined bend angle.

13. An improved brush applicator as set forth in claim 1, wherein the wand comprises a continuous rod or wire having a circular cross-section and a diameter in the range of about 10 mils to about 20 mils.

* * * * *